United States Patent [19]

Koster et al.

[11] 3,934,295

[45] Jan. 27, 1976

[54] ROCKER BEARING FOR BRIDGES ON SIMILAR STRUCTURES

[75] Inventors: Waldemar Koster, Forsbach, Germany; Reinhold Huber, Rorbas, Switzerland

[73] Assignee: Firma Kober AG, Glarus, Switzerland

[22] Filed: Jan. 28, 1974

[21] Appl. No.: 437,238

[30] Foreign Application Priority Data

| | | |
|---|---|---|
| Feb. 6, 1973 | Germany | 2305749 |
| May 17, 1973 | Germany | 2325141 |
| July 26, 1973 | Germany | 2337890 |

[52] U.S. Cl. ..... 14/16; 161/47; 248/22

[51] Int. Cl.[2] ..... E01D 19/06

[58] Field of Search ..... 14/16; 161/47; 308/2, 3 R, 308/238; 248/22, 23; 52/396

[56] References Cited

UNITED STATES PATENTS

| | | | |
|---|---|---|---|
| 3,329,472 | 7/1967 | Donnellan | 14/16 |
| 3,602,560 | 8/1971 | Memmel | 308/238 |
| 3,728,752 | 4/1973 | Andra | 14/16 |
| 3,756,551 | 9/1973 | Bishop | 248/22 X |
| 3,782,788 | 1/1974 | Koester | 14/16 X |
| 3,782,789 | 1/1974 | Koester | 14/16 X |

FOREIGN PATENTS OR APPLICATIONS

| | | | |
|---|---|---|---|
| 1,157,640 | 11/1963 | Germany | 14/16 |

*Primary Examiner*—Nile C. Byers, Jr.

*Attorney, Agent, or Firm*—Ernest A. Greenside

[57] ABSTRACT

The invention concerns a rocker bearing comprising a pair of bearing members, disposed between construction parts, and an elastic pressure cushion between the bearing members and for operation at large bearing rocking angles with improved flexibility of the pressure cushion there are provided one or more groups of sealing bodies at least in part embedded in the pressure cushion, each group containing bodies disposed at intervals in the region of an annular gap between the pair of bearing members.

28 Claims, 15 Drawing Figures

Fig.9
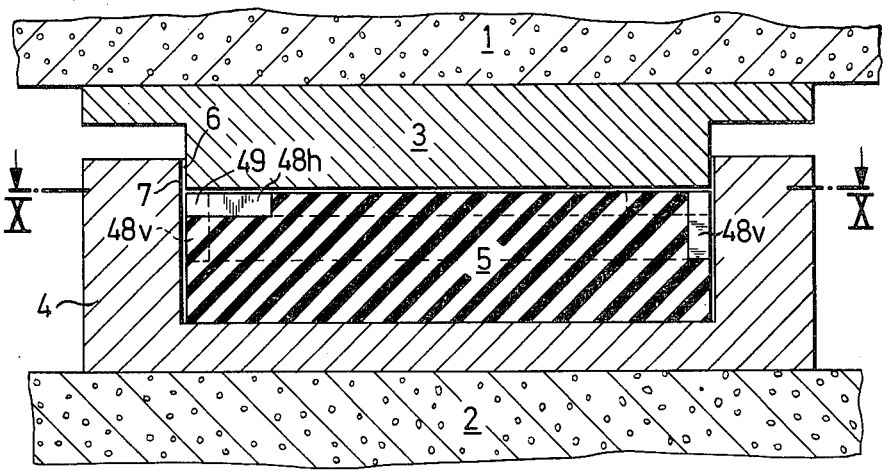
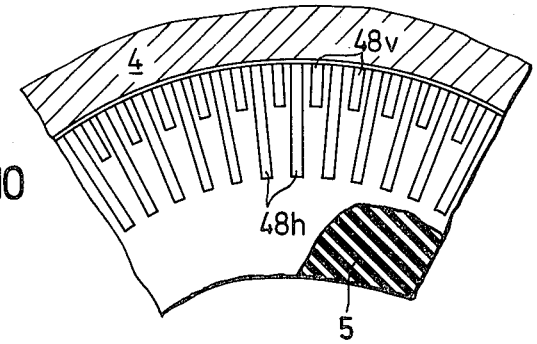
Fig.10
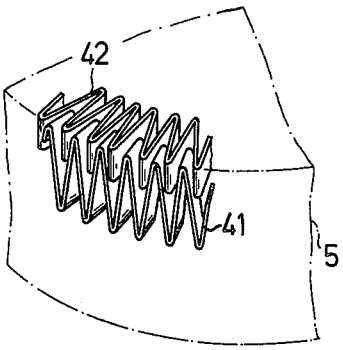
Fig.11
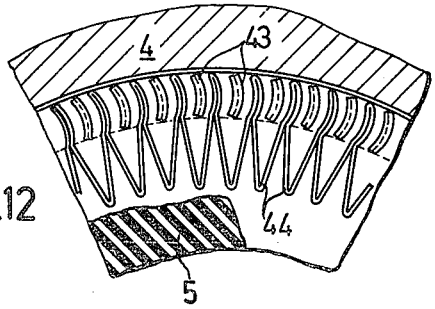
Fig.12

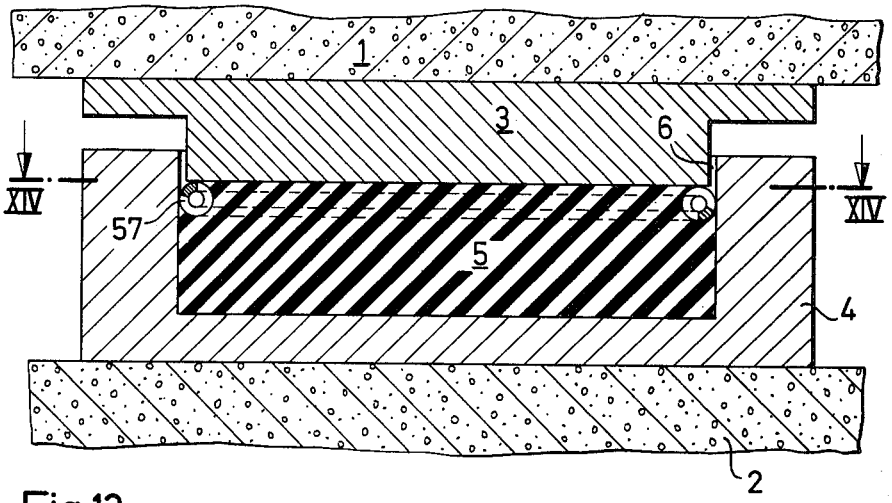
Fig.13
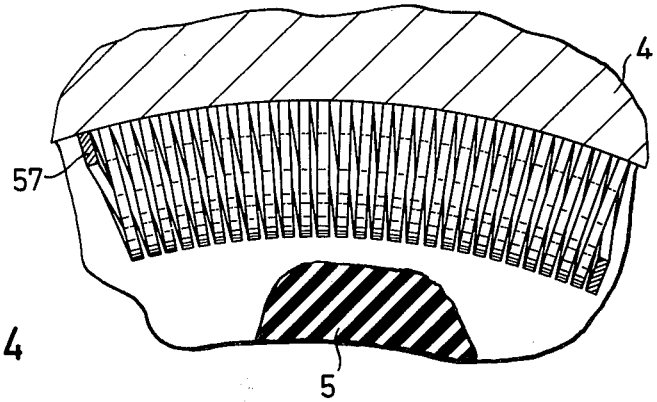
Fig.14
Fig.15
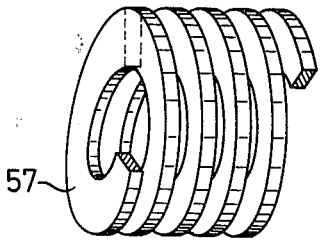

ROCKER BEARING FOR BRIDGES ON SIMILAR STRUCTURES

BACKGROUND OF THE INVENTION

This invention relates to a rocker bearing for bridges, and similar structures.

Rocker bearings have previously been proposed which comprise an elastic pressure cushion, disposed between an upper and lower bearing member, the lateral surface of which is completely or partially enclosed by one or more annular casing parts, and sealing bodies which consist, at least in part, of a more highly work-resistant material than the cushion material. The sealing bodies are disposed in front of the gap or gaps between the casing parts and/or the bearing parts and the inner surface of the casing parts and are joined to the pressure cushion to form a one-piece construction unit.

Sealings for cup-shaped bearings are known, which comprise sealing rings, countersunk in the pressure cushion, so as to be capable of movement relative to the interstice to be sealed. Its disadvantage is that abrasion occurs on the side of the pressure cushion, owing to canting or distortion of the sealing rings; in the event of extreme rocking action, this can cause the seal to be damaged.

A further known rocker bearing provides the improvement, in relation to the loosely inserted sealing rings, of eliminating abrasion on the side of the pressure cushion by a one-piece connection of the sealing body to the pressure cushion. But even if the phenomenon of abrasion, in the event of relative movement between the sealing bodies and the remainder of the pressure cushion, is eliminated, in these known pressure cushions, the connection between the sealing bodies and the remainder of the pressure cushion is nevertheless subjected to stress in extreme rocking positions, which causes the angle of rocking to be restricted.

The invention on the other hand has its object the provision of a rocker bearing of the aforementioned type for particularly large rocking angles, which provides improved flexibility of the pressure cushion in spite of greater stress.

SUMMARY OF THE INVENTION

The foregoing aim is thereby attained according to the invention in that the sealing bodies consist of lamellae, which are disposed at intervals and in a circular arrangement adjacent the gap and which are at least in part embedded in the pressure cushion with a narrow side directed radially outwardly.

Owing to the division of the sealing ring into individual lamellae, the surface of the sealing ring for connection to the pressure cushion is substantially enlarged, thus providing a pressure cushion for particularly high stress. The work material consumption for the lamellae is also ideal, since the lamellae can be adapted to any particular application of the bearing by variation of their dimensions and the number employed.

Since the lamellae are disposed at intervals, they can easily be adapted to movements of the pressure cushion, during the rocking action, for example, by occupying a position so inclined that their narrow surfaces respectively abut the bearing surfaces defining the gap to be sealed. Owing to the narrow intervals between the lamellae, any emergence of soft pressure cushion material between the lamellae is prevented.

The sealing body constructed according to the invention, that is its construction as a set of lamellae, also facilitates the choice of material. Whilst particularly flexible materials can be utilised for the cushion, the selection of the material for the lamellae depends solely on this material being resistant with regard to its shape, in front of the gap, i.e. synthetic materials or metals which are highly or very highly resistant, e.g. steel, brass, polyamides, polyacetates, possibly reinforced with glass fibres or analagous hard elastic materials, come under consideration as material for the lamellae. Finally, the problem of avoiding impact of the two ring ends which normally occurs in the known sealing rings is completely eliminated by the present invention; separation of the individual lamella in each set of lamellae is easily possible by permitting the material of pressure cushion to extend therebetween.

To provide the pressure cushion with an even softer and particularly well-fitting adaptation to angular changes due to the rocker action of the bearing, a further proposal of the invention consists in providing two different groups of lamellae in which the groups of lamellae are disposed in an alternating sequence arrangement, one group extending with a longer narrow side parallel to the bearing surface of the respective bearing member and the other group of lamellae extending with a longer narrow side parallel to the inner surface of the casing member.

This feature is based on the idea that one group of the lamellae participates in the movement of the bearing part and the other group participates in the movement of the casing member such that, owing to the bonding attained by the relatively soft pressure cushion material, the sealing body acts as a soft joint, which facilitates a force-free angular adaptation on rocking movement. Thus the pressure cushion material is additionally utilised, particularly in respect of its rotary elasticity.

The two aforementioned proposals according to the invention proceed from the fundamental idea of firmly connecting a sealing body of highly resistant material to the flexible pressure cushion material, for the reduction of abrasion, in the sealing area of the pressure cushion. Use has thereby been made of the knowledge that it is no longer necessary, assuming a firm connection, for the pressure cushion to be completely covered by the sealing body in the area adjacent the gap to be sealed. Owing to the firm bonding of the pressure cushion material between the lamellae, the material is prevented from emerging into the gap to be sealed. Thus the sealing body, which has been divided into lamellae fulfils every requirement in respect of a sealing action free from abrasion, but has the advantage, in relation to the known one-piece sealing ring, of following all deformation of the pressure cushion produced by the rocking action of the bearing in a flexible and force-free manner.

To simplify production of the pressure cushion utilised with the sealing ring, divided into lamellae according to the invention, provision is made, according to a further feature of the invention, for the sealing body to consist of a wire helix embedded in the material of the pressure cushion, disposed with its axis adjacent the gap.

This type of wire helix has all the advantages of the sealing body constructed in the form of lamellae; in particular, it sets no limits for the rocking resistance of the pressure cushion, eliminates abrasion and the emergence of pressure cushion work material in the vicinity of the gap to be sealed and facilitates well-fitting adaptation to angular changes caused by rocking movements of the bearing. Together with these advantages, there are also considerable simplifications in production. The wire spiral can be produced with ease and economy as a continuous part of optional length. Owing to its inherent rigidity, it can be brought into the most advantageous position in the vulcanisation mold for the pressure cushion and vulcanised without the separate expense of a support therefor.

The wire formed into a wire helix can be of circular or rectangular cross-section. A wire of circular cross-section can be produced and coiled more easily. A wire of rectangular cross-section is more rigid and offers a larger connection surface for the bonding operation with the pressure cushion material. For dimensioning of the wire helix, care should be taken with regard to the correlation of the intervals between the coils and the thickness of the wire. The interval must be small enough to prevent the emergence of pressure cushion work material therebetween and the strength of the wire must be sufficient to prevent permanent deformation of the wire helix. The wire helix forms a resistant sealing body with the pressure material located on its interior. This sealing body is inherently so stable that, on rocking movement, a rolling movement of the cover edge on the surface of the wire helix occurs and jamming of material is thereby completely eliminated.

The pressure cushion work material between the lamellae and about the lamellae or in the interior of the wire spiral and about the wire spiral advantageously possesses greater rigidity in relation to the material of the remainder of the pressure cushion; whilst rubber is a suitable material, for example, for the core of the pressure cushion, the reinforced region can consist of a harder elastomer, for example, polyurethane, which is distinguished by greater rigidity and hardness.

In a pressure cushion made of rubber, the lamellae or wire spiral can be vulcanised in the pressure cushion, but they can also be secured in the pressure cushion by means of a re-moulding operation with pressure cushion material, e.g. polyurethane.

An advantageous embodiment of the invention consists in that, for the proposal comprising two groups of lamellae, the lamellae belonging to each group are at least connected together in an alternating manner on their shorter narrow surfaces. Within the scope of this embodiment, it is advantageous to dispose the lamellae of each group in an alternating arrangement so as to extend in an opposed or inclined position in relation to the surface of the bearing or casing members, adjacent the respective narrow surfaces of the lamellae. Each group of lamellae can thereby consist of corrugated bands or zig-zag shaped bands, the straight sections of which form the lamellae.

Owing to the advantageous construction, wherein intermediate layers of pressure cushion material are located between the lamellae in the vicinity of the lamellae for the toothing, a seal is produced, which is relatively rigid in the area directly adjacent the interstice, since at this point the intervals between the lamellae belonging to the various groups or bands are only half as large as the intervals between the lamellae of the same group or band.

All types of a rocker bearing obviously come within the scope of the invention, e.g. its modification in the capacity of a sliding bearing. In its modification as a sliding bearing, the lamellae can comprise a recess for receiving a sliding layer.

BRIEF DESCRIPTION OF THE DRAWINGS

Specific embodiments of the invention will now be described by way of example with reference to the accompanying drawings, in which:

FIG. 9 is a vertical cross-section of a roller bearing with a sealing body comprising two groups of lamellae;

FIG. 10 is a partial section, made in the plane X-X of FIG. 9;

FIGS. 11 and 12 each show a part of two different embodiments of a sealing body;

FIG. 13 is a cross-section of a rocker bearing, taken along a vertical plane, which comprises a sealing body containing a wire spiral;

FIG. 14 is a view according to the line XIV-XIV of FIG. 13, in partial section and, FIG. 15 shows a part of the wire spiral.

DESCRIPTION OF THE INVENTION

Figure 1:
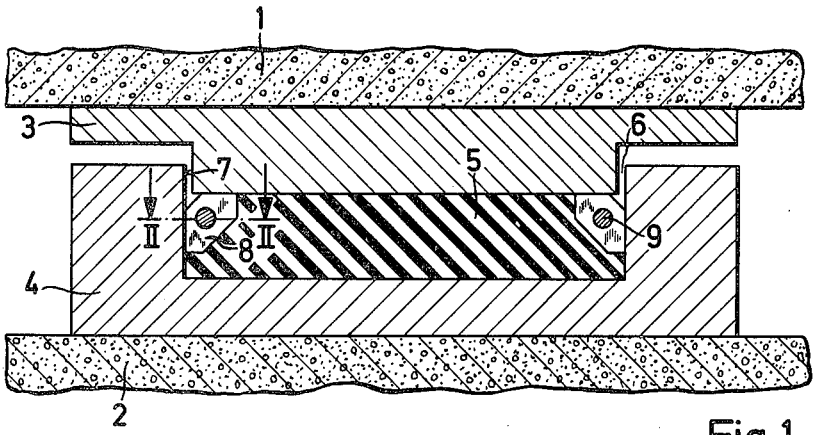
FIG. 1 is a vertical cross-section of the first embodiment of a rocker bearing.
Figure 2:
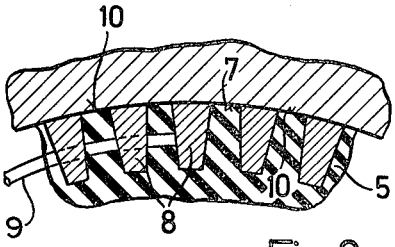
FIG. 2 is a partial section, made in the plane of the line II—II of FIG. 1.

Referring to the drawings, FIG. 1 shows a cup-shaped bearing, comprising an upper construction part 1 and a lower construction part 2. A bearing cover 3 and a cup 4, in which the cover engages from above, are disposed between the construction parts. The bearing cover 3 is supported on a pressure cushion 5, disposed in the interior of the cup 4. Lamellae 8 are provided for sealing the gap 6 between the bearing cover 3 and the inner surface 7 of the cup casing. The lamellae 8 are movably inter-connected by means of ribs 9. The lamellae 8 are located, as shown in FIG. 2, at intervals and spaced apart from each other on the periphery of the pressure cushion 5. Each lamella 8 takes the cross sectional form of a wedge, which diverges outwardly towards the radial outer surface 10 of the cushion as seen in FIG. 2. Under stress, the narrow outer vertical edge surfaces of the lamellae adjoining the radial outer surface 10 of the pressure cushion, abut the inner surface 7 of the cup.

Figure 3:
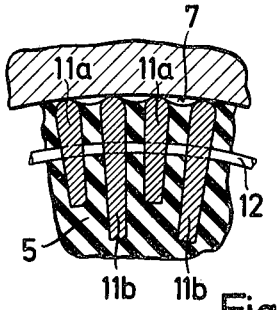
FIG. 3 is a partial section, in the view according to FIG. 2, but of a different embodiment.

A different embodiment of the lamellae and the pressure cushion is shown in FIG. 3, shown in a horizontal partial section according to FIG. 2. The outer edge surfaces of the lamellae **11*a* and 11*b* have a rounded or ball-shaped construction. The pressure cushion material between the lamellae has a concave shape on the outer lateral surface of the pressure cushion. Owing to this construction, the contact surface between the pressure cushion material and the inner surface 7 of the cup is greatly reduced and consequently, the frictional forces, which are otherwise present, are thus decreased. The lamellae are connected together by means of ribs 12 to form a uniform set of lamellae. The lamellae are constructed of varying lengths in an alternating manner, the lamellae 11a thereby being shorter than the lamellae 11b**.

Figure 4:
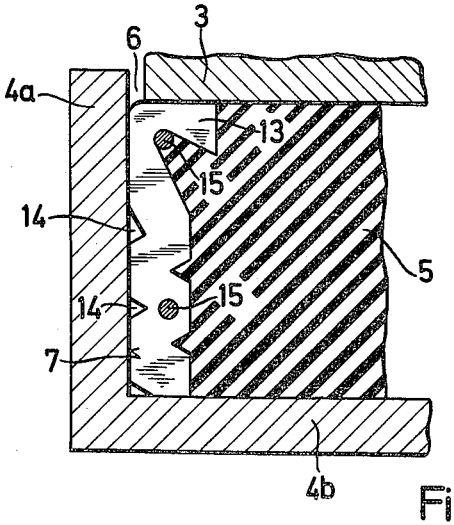
FIGS. 4 to 8 are each partial sections, in the vertical sense, of further embodiments.

The partial sections of a cup-shaped bearing according to FIG. 4 shows lamellae 13, extending over the entire cushion height. The lamella illustrated has a rounded construction in the corner in front of the gap 6, between the bearing cover 3 and cup casing 4a. To increase its mobility and its flexibility against shock owing to rocking action by the bearing, the lamella is provided with indentations 14. The lamella extends downwards as far as the upper surface of the cup base 4*b*. The horizontally extending portion and the inclinations of the lamella enable the lamellae to respond to load condition and permit swift resilient return to the initial portion after removal of the load. Since the lamellae 13 do, in the main, abut the inner surface 7 of the cup casing 4a and the lamellae extend over the entire height of the pressure cushion, friction between the pressure cushion and the inner surface 7 of the cup casing 4a is greatly reduced. The ribs 15 ensure cohesion of the lamellae, creating an assembly which substantially facilitates their mounting on the pressure cushion.

Figure 5:
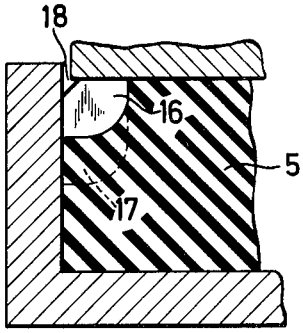

FIG. 5 shows a partial section of a further embodiment of a rocker bearing. Lamellae in the form of discs 16 are disposed at intervals, one behind the other and are of varying lengths, as shown at 17. The space between the lamellae is of course also filled with pressure cushion material in this embodiment. The lamellae are attached at 18 adjacent the gap.

Figure 6:
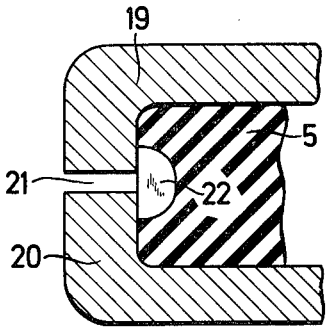

In the embodiment according to FIG. 6, the rocker bearing consists of an upper cup 19 and a lower cup 20. The casings of the two vessels define a gap 21 between them. The lamellae 22 are inserted in the pressure cushion adjacent the gap 21, for the purpose of sealing said gap. The lamellae 22 have a flattened semi-circular shape; their outer straight margin abuts the inner surfaces of the casings for the two cups.

Figure 7:
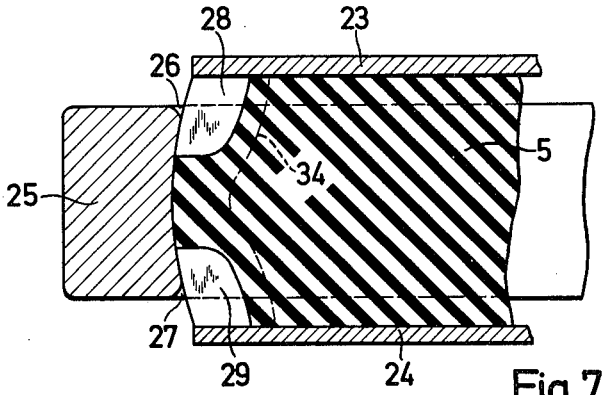

FIG. 7 shows a pressure cushion 5, which is connected to an upper plate 23 and a lower plate 24. A steel ring 25, which encloses the pressure cushion on the exterior, serves to reinforce the pressure cushion, which is under stress between the constructions parts, not illustrated, against horizontal displacement. The two gaps 26 and 27 between the steel ring and the upper or lower plate 23 or 24 respectively seal the lamellae 28 and 29, a number of lamellae 28 thereby being combined to form an upper set of lamellae and a corresponding number of lamellae 29 combined to form a lower set of lamellae. The lamellae 28 and 29 can also be firmly connected to the lower surface of the plate 23 or the upper surface of the plate 24 respectively. The boundary between the softer core and the harder external zone of the pressure cushion is indicated by the line 34.

Figure 8:
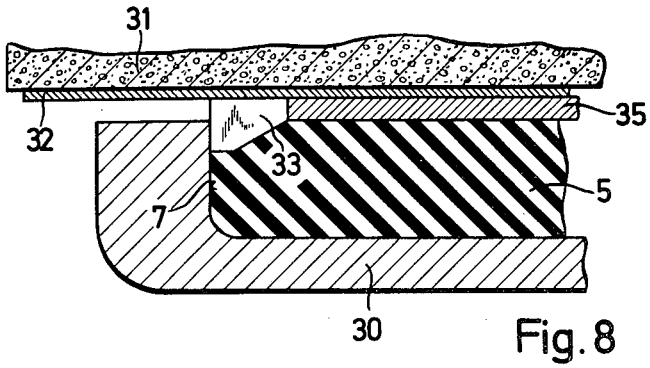

FIG. 8 shows a cup-shaped bearing comprising a lower cup 30, a pressure cushion 5, an upper bearing part 31 with a sliding plate 32, which is disposed below said bearing part and is constructed, for example, of hard, chromium-plated steel plate. On their outer narrow sides, the lamellae 33 abut said sliding plate on one side and the inner surface 7 of the cup casing 30 on the other. A counter slide plate 35 of, for example polytetrafluoroethylene, is connected, in the inner area of the lamellae.

In the embodiments described above the lamellae are approximately from 3 to 5 mm thick; the interval between the lamellae is preferably from 2 to 3 mm.

FIG. 9 shows a cup-shaped bearing comprising an upper construction part 1 and a lower construction part 2. The bearing cover 3, in the capacity of an upper bearing member, and the cup 4, in the capacity of a lower bearing member and in which the cover engages from above, are disposed between the construction parts. The bearing cover 3 is supported on the pressure cushion 5, disposed in the interior of the cup 4. Lamellae 48*h* and 48v are provided for sealing the gap 6 between the bearing cover 3 and the inner casing surface 7. The lamellae 48*h* and 48*v* alternate over the periphery of the pressure cushion. The lamellae 48*h* extend horizontally from the radial outer surface of the pressure cushion and adjacent the top of the cushion; the lamellae 48*v* extend vertically from the upper side of the pressure cushion. The horizontal lamellae 48*h* and the vertical lamellae 48*v* overlap in the area 49, located directly in front of the gap 6. Under stress the narrow sides of the lamellae adjoining the upper surface of the pressure cushion abut the inner casing surface 7*a* of the cup 4 and the underside of the cover 3.

As described with regard to FIGS. 1–10, each of the lamellae are described generally flat and planar platlet members having an upper edge parallel to the bearing surface of the cover bearing and an outer edge parallel to the surface of the vertical peripheral casing, against which they are adapted to respectively abut. Thus, the lamellae lie perpendicular to the bearing surfaces spaced at uniform intervals about the periphery of the pressure cushion. The lamellae are set in the softer pressure cushion so as to be relatively movable in the direction of the bearing load with respect to each other, not withstanding the use of an interconnecting rib, acting to hold them together for ease of assembly; the elongated rib, as described, being itself flexible.

In FIG. 10, the lamellae 48*h* and 48*v* are shown in a plan view of the pressure cushion 5, such that the narrow sides of the lamellae are visible. In the embodiment according to FIGS. 9 and 10, the lamellae each have an elongated construction in the form of a blade, the longer narrow side of the horizontal lamellae 48*h* thereby extending parallel to the underside of the cover 3 and the longer narrow side of the vertical lamellae 48*v* extending parallel to the inner casing surface 7 of the cup 4.

FIGS. 11 and 12 each show embodiments of the lamellae, wherein both the vertical lamellae and also the horizontal lamellae are in each case connected together at opposite ends, the sections forming the lamellae 42 thereby being located in an inclined position in relation to the radial sense (or the vertical sense on the upper surface of the pressure cushion respectively with a bearing not of circular cross-section). The lamellae 41, embedded vertically in the pressure cushion are of an identical construction to the horizontal lamellae 42. A further development of FIG. 11 represents the embodiment according to FIG. 12. In this case the lamellae 43 or 44 respectively are curved in the manner of an articulated socket in the region 49, in which they are engaged in each other. The horizontal lamellae 44 form a first band, embedded horizontally in the pressure cushion, rotating along the gap to be sealed; a band of analogous construction, which has been embedded in the pressure cushion vertically to the first band, contains the lamellae 43, which abut the upper surface of the pressure cushion 5 at their upper connection points.

FIG. 13 shows a bearing cup comprising an upper construction part 1 and a lower construction part 2. The bearing cover 3, in the capacity of an upper bearing member, and the cup 4, which functions as a lower bearing member and in which the cover engages from above, are disposed between the construction parts. The bearing cover 3 is supported on the pressure cushion 5, disposed in the interior of the cup 4 and is made of a flexible material, for example, natural or synthetic rubber. In order to prevent escape of the pressure cushion work material through the gap 6 under stress, a wire helix 57 is provided as a seal along the upper edge of the pressure cushion and in a circular arrangement adjacent the gap. The intervals between the coils of the wire helix have been shown as being relatively large for simplification of the drawings. A practical embodiment of the wire helic has an outer diameter of approximately 12 mm; the cross-section of the wire is equivalent to a rectangle having a lateral length of 1 mm and 4 mm; the interval between successive coils is approximately 0.3 mm. A preferred material for the wire is brass or bronze; steel or synthetic material is however also suitable, such as hard polyamide. The space in the interior of the wire helix and between the individual coils is filled with pressure cushion work material. A firm one-piece connection between the wire helix 57 and the pressure cushion 5 is obtained by the embedding of the wire helix.

FIG. 14 shows, on a larger scale, a section of the pressure cushion 5 in plan view and it is thereby clear that the cup-shaped bearing is constructed with a circular outline and the wire helix shown as being raised out of the pressure cushion for purposes of clarification is curved so as to correspond to the circular shape of the cup-shaped bearing.

FIG. 15 shows a section of the wire helix, on a larger scale, comprising a wire of rectangular cross-section, which is wound edgeways. The inclined arrangement of the wire imparts increased stability to the wire helix 57 and offers the pressure cushion material between the coils of the wire helix a large connection surface. The rectangular cross-section of the wire is shown by dotted lines at one of the upper vertices of the wire coil shown in FIG. 15. The outline shape of the pressure cushion can of course differ from the circular shape.

In the embodiments of FIGS. 11–15 the lamellae although not individual planar members, retain the same characteristics as those of FIGS. 1–8. Each of the discrete turns of the helix or each fold of the corrugated band defines horizontal edge parallel to the bearing surface and a vertical edge parallel to wall of the peripheral casing, against which they respectively abut. Because both the helix and the corrugated band are highly flexible, the individual turn or fold move relatively to each other under application of the bearing load.

What we claim is:

1. A rocker bearing comprising upper and lower bearing members having opposed bearing surfaces for supporting loads applied to one of the other said members, an elastic pressure cushion interposed between the bearing surfaces, said elastic pressure cushion having its periphery at least in part enclosed by at least one peripheral casing wall, a plurality of lamellae embedded within said elastic pressure cushion adjacent one bearing surface and spaced about the periphery thereof, each of said lamellae being formed of a material less resilient than said elastic pressure cushion and having a narrow edge extending parallel to said one adjacent bearing surface and a narrow edge extending parallel to the surface of said peripheral casing wall, each of said edges being arranged within said cushion to abut the respective surfaces on application of a load to said bearing members.

2. The rocker bearing according to claim 1 wherein one of the bearing members is fixed and is cup shaped and said other bearing member comprises a cover therefore adapted to be movable within said one bearing member, said pressure cushion being located within said one bearing member and said lamellae being arranged on the surface of said pressure cushion to engage said cover.

3. The rocker bearing according to claim 2 wherein said means for connecting said lamellae comprises a lateraly disposed rib formed of flexible material.

4. The rocker bearing according to claim 1 including means for flexibly interconnecting each of said lamellae to form a unitary set thereof.

5. The rocker bearing according to claim 1 wherein alternate ones of said lamellae have at least one edge of different lengths than the corresponding edge of the adjacent lamellae.

6. The rocker bearing according to claim 5 wherein a first set of alternate ones of said lamellae have their edge extending parallel to the surface of said peripheral casing wall of a length longer than the corresponding edge of the adjacent lamellae and a second set of alternate ones of said lamellae having their edge extending parallel to the bearing surface of a length longer than the corresponding edge of the adjacent lamellae.

7. The rocker bearing according to claim 5 wherein the lamellae of one group are interconnected by means arranged along a shorter narrow side.

8. The rocker bearing according to claim 5 wherein the lamellae of one set are alternately disposed so as to extend in an angular relationship to the lamellae of the other set.

9. The rocker bearing according to claim 1 wherein said pressure cushion is formed of a generally highly resilient material provided with a section of substantially less resilient material surrounding said lamellae.

10. The rocker bearing according to claim 1 wherein the narrow edge extending parallel to the surface of said peripheral casing wall extends the entire height of the lateral surface of the pressure cushion.

11. The rocker bearing according to claim 8 wherein said lamellae are provided with cut out portions at least along the narrow edge parallel to said casing wall, increasing the flexibility thereof.

12. The rocker bearing according to claim 1 wherein the side surfaces of said lamellae are worked to provide an abrasive surface fascilitating embedding within said pressure cushion.

13. The rocker bearing according to claim 1 wherein said pressure cushion is formed of rubber and wherein said lamellae are vulcanized therein.

14. The rocker bearing according to claim 1 wherein said pressure cushion is formed in two sections, one of said section embedding said lamellae, said lamellae being first embedding within said section and said section being remolded with the other of said pressure cushion sections.

15. The rocker bearing according to claim 1 wherein said narrow edge extending parallel to said peripheral casing wall has convex cross sections.

16. The rocker bearing according to claim 1 wherein the surface of the pressure cushion is formed so as to rebound relative to the narrow edges of the lamellae, in the region between said lamellae.

17. The rocker bearing according to claim 1 wherein said lamellae are curved.

18. A rocker bearing comprising a pair of opposed bearing members at least one of which is relatively movable axially toward and away from the other, a resilient pad located between said members to absorb the load placed on said bearing members and a plurality of vertically disposed platlet supports uniformly spaced about the periphery of said pad, said supports being formed of a material less resilient than said pad and embedded within said pad and having one edge lying substantially flush with the surface of said pad for abutment with the movable bearing member.

19. The rocker bearing according to claim 18 wherein said pad is surrounded by a peripheral enclosing wall and said platlets have a second edge lying substantially flush with the peripheral surface of said pad in abutment with the peripheral enclosing wall.

20. The rocker bearing according to claim 19 wherein said first and second edges are perpendicular to each other and lie in a plane arranged parallel to the direction of load applied to said bearing member.

21. A rocker bearing comprising upper and lower bearing members having opposed bearing surfaces for supporting loads applied to one of the other said members, an elastic pressure cushion interposed between the bearing surfaces, said elastic pressure cushion having its periphery at least in part enclosed by at least one peripheral casing wall, a wire helix formed of a material less resilient than said elastic pressure cushion embedded within said elastic pressure cushion adjacent one bearing surface and extending about the periphery thereof, the individual turns of said helix being disposed with its axis rotating in a plane parallel to the bearing surface and having a narrow edge extending parallel to said one adjacent bearing surface and a narrow edge extending parallel to the surface of said peripheral casing wall, each of said edges being arranged within said cushion to abut the respective surfaces on application of a load to said bearing members.

22. The rocker bearing according to claim 21 wherein the outer surface of the pressure cushion is formed of the material constructed so as to rebound relative the outer surface of the wire helix, in the region between the turns of said helix.

23. The rocker bearing according to claim 21 wherein said helix is formed of wire having a circular cross section.

24. The rocker bearing according to claim 21 wherein said helix is formed of wire having a rectangular cross section.

25. A rocker bearing comprising upper and lower bearing members having opposed bearing surfaces for supporting loads applied to one of the other said members, an elastic pressure cushion interposed between the bearing surfaces, said elastic pressure cushion having its periphery at least in part enclosed by at least one peripheral casing wall, at least one continuous band of material less resilient than said elastic pressure cushion embedded within said elastic pressure cushion adjacent one bearing surface and extending about the periphery thereof, said band being folded in zig-zag corrugation to form lamellae, the fold lines of said corrugation and the longitudinal edge of said band forming narrow edges one of which extending parallel to said one adjacent bearing surface and the other extending parallel to the surface of said peripheral casing wall, each of said edges being arranged within said cushion to abut the respective surfaces on application of a load to said bearing members.

26. The rocker bearing according to claim 25 including a pair of corrugated bands, the longitudinal edge of one band being arranged parallel to one adjacent bearing wall, and the longitudinal edge of the other band arranged parallel to the surface of the peripheral wall, the corrugations of said bands being alternately arranged with respect to each other.

27. The rocker bearing according to claim 25 wherein said corrugations are curved.

28. Method for the production of a pressure cushion for a rocker bearing assembly comprising the steps of providing a plurality of lamellae having a pair of perpendicularly directed edges with a highly flexible interconnecting rib, providing a mold in the desired shape of said pressure cushion, arranging said interconnected lamellae within said mold and arranging the same in accordance with the shape of said mold to extend uniformly about the periphery thereof, filling said mold to form said cushion and embed said lamellae with a material of greater resiliency than said lamellae and so that the narrow edges of said lamellae extend respectively adjacent the face of said cushion and the lateral peripheral surface thereof and curing said material.

* * * * *